United States Patent [19]

Dunn et al.

[11] Patent Number: 4,747,538

[45] Date of Patent: May 31, 1988

[54] WATER WALL

[75] Inventors: Patricia A. Dunn, Ellicott City, Md.; Clyde T. Dunn, Strykersville, N.Y.; Gregory G. Dunn, Ellicott City, Md.

[73] Assignee: Delta Tech, Inc., Ellicott City, Md.

[21] Appl. No.: 837,897

[22] Filed: Mar. 10, 1986

[51] Int. Cl.[4] ..... F21P 7/00

[52] U.S. Cl. ..... 239/20; 239/23; 239/124; 239/135; 239/289; 261/103; D23/213

[58] Field of Search ..... 239/18, 20, 22, 23, 239/104, 120–122, 124, 135, 289; 261/103, 106; D23/13

[56] References Cited

U.S. PATENT DOCUMENTS

| | | | |
|---|---|---|---|
| 1,780,687 | 11/1930 | Smith | 239/23 |
| 2,097,425 | 10/1937 | Wandell | 261/103 |
| 3,211,378 | 10/1965 | Zysk | 239/20 |
| 3,387,602 | 6/1966 | Thomason | 126/432 |
| 3,409,223 | 11/1968 | Gosh | 239/23 |
| 3,901,439 | 8/1975 | Willis | 239/18 |
| 3,921,902 | 11/1975 | Erickson | 239/17 |
| 3,991,938 | 11/1976 | Ramey | 126/432 |
| 4,197,833 | 4/1980 | Pelish | 126/432 |
| 4,217,315 | 8/1980 | Keeler, II | 239/23 |
| 4,351,781 | 9/1982 | Blatter | 261/106 |
| 4,428,361 | 1/1984 | Straza | 126/432 |

FOREIGN PATENT DOCUMENTS

| | | | |
|---|---|---|---|
| 260375 | 10/1912 | Fed. Rep. of Germany | 239/18 |

*Primary Examiner*—Andres Kashnikow
*Assistant Examiner*—Michael J. Forman
*Attorney, Agent, or Firm*—Saidman, Sterne, Kessler & Goldstein

[57] ABSTRACT

A combined decorative object for household decoration and humidification is disclosed. The device makes use of the aesthetic qualities of flowing water, and comprises an inclined panel having discontinuities formed therein such that water flow thereover is interrupted in a manner which is pleasing to the eye. The panel may comprise a number of panes of glass in edge-overlapping, abutting relation to one another such that water flowing over the panels essentially adheres to the panels, such that splashing is avoided in favor of burbling. In this way, excessively large water droplets are not released to the atmosphere, which tends to damage other household goods in the vicinity of the device. In the preferred embodiment, the device is a free-standing construction comprising a base member for containing a pool of water and support members for supporting a multiple-paned panel assembly, the lower edge of which is disposed in the pool of water, so that the splashing at the lower edge of the panel assembly is similarly avoided. A trough member provides a laminar flow of water over the panel assembly; a pump refills the trough continually. Temperature control of the water may also be provided.

31 Claims, 2 Drawing Sheets

WATER WALL

FIELD OF THE INVENTION

This invention relates to home furnishings which are both decorative and functional. More particularly, this invention relates to a self-contained water wall, that is, a waterfall in wall-like form, for interior use, which serves both as a decorative item of great beauty and as a humidifying means.

BACKGROUND OF THE INVENTION

The use of moving water as a decorative element in the home or in public buildings is well known. Fountains have, of course, been architectural ornamentation in public places since time immemorial. More recently, artificial, self-contained decorative items using flowing water as an important decorative element have also become known. See, for example, Zysk U.S. Pat. No. 3,211,378. Zysk shows a "wall fountain" in which a unitary housing is formed for insertion into a wall or the equivalent. The unitary housing has a back wall inclined at between approximately 5° and 10° to the vertical. Water is caused to flow through a number of orifices along the top of the inclined wall, so as to flow gently down along the wall, being eventually collected gently down therein, terminating in a pool at the bottom of the wall, for pumping back to the orifices. The back wall of the Zysk wall fountain is smooth. Applicants find that such a smooth, unbroken flow of water, while certainly not unattractive, is not as appealing to the eye as might be desired.

Gosh U.S. Pat. No. 3,409,223 shows a "method of assembling an artificial waterfall" in which a pair of inclined planar members 30 and 20 are arranged such that one is spaced some distance above the other, such that a sheet of water impinging on an upper plate falls some distance through the air before landing on a lower plate; the water than drops into a pool. The Gosh waterfall is disclosed in connection with outdoor use. This may be because the water falling from one plate to the other through some distance would necessarily result in some splashing. If used indoors, the Gosh device would cause water to be splashed about the area of the waterfall, which would ruin many commonly employed home furnishings. For example, rugs, hardwood floors, other objets d'art, and the like should all be prevented from continued exposure to moisture. The Gosh waterfall, therefore, would not be suitable for interior use in many homes, and is therefore not as useful as might be desired.

Particularly with the advent of higher energy prices, homeowners have realized that maintenance of the correct humidity is important to maintaining a feeling of comfort in the home, particularly in winter. Keeler U.S. Pat. No. 4,217,315 shows a "Humidifier and Moving Indoor Sculpture" in which water is pumped to the top of a member, which comprises generally helical planes extending downwardly about a generally circular member. The member floats on a pool of water, such that when water flows down the helices, the member tends to spin. Humidity is stated to be added to the atmosphere thereby. Keeler shows water dropping relatively great distances, from various portions of the peripheries of the planar helices into the pool, such that substantial splashing would occur. As in the case of the Gosh patent discussed above, this would prevent the Keeler device from being used in most homes. Note also that the Keeler device is relatively massive; see FIG. 1.

A need therefore exists in the art for a home furnishing in which the eye-attractive qualities of flowing water are employed in a very decorative manner, which provides a degree of humidity to the air of a home within which this device is located, yet in which splashing deleterious to other home furnishings is substantially avoided.

SUMMARY OF THE INVENTION

It is therefore an object of the invention to provide a "water wall" for use in the home, which provides a decorative effect owing to its optimum employment of the eye-attractive qualities of flowing water, and in which the water flow is smooth, such that splashing is substantially avoided and so that the device of the invention can be placed in close proxmity to delicate home furnishings without damage thereto.

It is a further object of the invention to provide a decorative home furnishing device which provides an attractive appearance owing to the utilization of the qualities of flowing water, and in which humidity is provided to the air, yet in which splashing or the like is essentially eliminated, whereby use of the device is not restricted to areas of the home in which only water-impermeable home furnishings are arranged.

The present invention meets the objects of the invention and needs of the art discussed above by provision of an improved water wall, which comprises a unitary free-standing device. The device includes a base for enclosing a pool of water, a pair of support members and a multiple-paned assembly supported by the support members. The multiple-paned assembly includes a number of essentially flat members, which may be formed of glass or the like, which are disposed in edge-overlapping, abutting relationship to one another. This assembly is supported at an angle of between about 0°–15° with respect to the vertical. A trough is disposed above the uppermost of the panels with a continuous groove or a number of holes in its lowest portion, to provide an essentially laminar, that is, sheet-like, flow of water to the uppermost of the panels. The inclination of the panels, the horizontal spacing of the edges of ones of the panels from the surface of those beneath, and the water flow rate are all chosen such that water flow over the panels is smooth, and not turbulent. Flow over the abutting edges of the panels is "burbling," rather than splashing, whereby damage to other goods by water is avoided. In the preferred embodiment, the lowermost panel is arranged to have its lower edge beneath the surface of the water in the pool.

BRIEF DESCRIPTION OF THE DRAWINGS

The invention will be better understood if reference is made to the accompanying drawings, in which.

DESCRIPTION OF THE PREFERRED EMBODIMENTS

Figure 1:
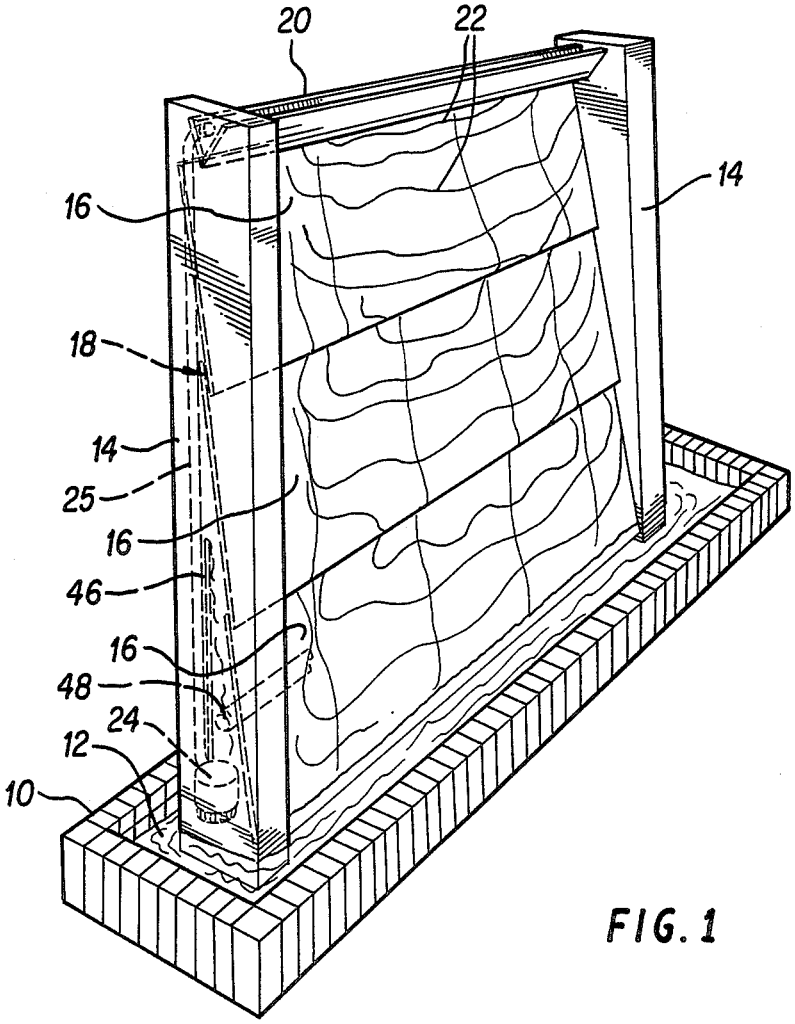
FIG. 1 shows a perspective view of the water wall of the invention.

FIG. 1 shows, as mentioned, a perspective view of the water wall according to the invention. It comprises a base member 10 which encloses a pool of water, indicated generally at 12. Mounted to the base member 10 are uprights or support members 14, which together support a number of generally planar panels or panes 16 of a multiple-paned waterfall panel assembly 18. The supports 14 or the uppermost panel may also support a trough 20, which may have a groove at its lowest portion or a number of holes formed therein for dispersing an essentially laminar, i.e., sheet-like, flow of water, indicated generally at 22, downwardly over the panels 16 of the assembly 18. A pump 24 shown in phantom may be provided to pump water from the pool 12 via a pipe 25 to the trough 20 for recycling the same. Additional details of the embodiment of the invention shown in FIG. 1 will be made clear if reference is also made to FIG. 2.

Figure 2:
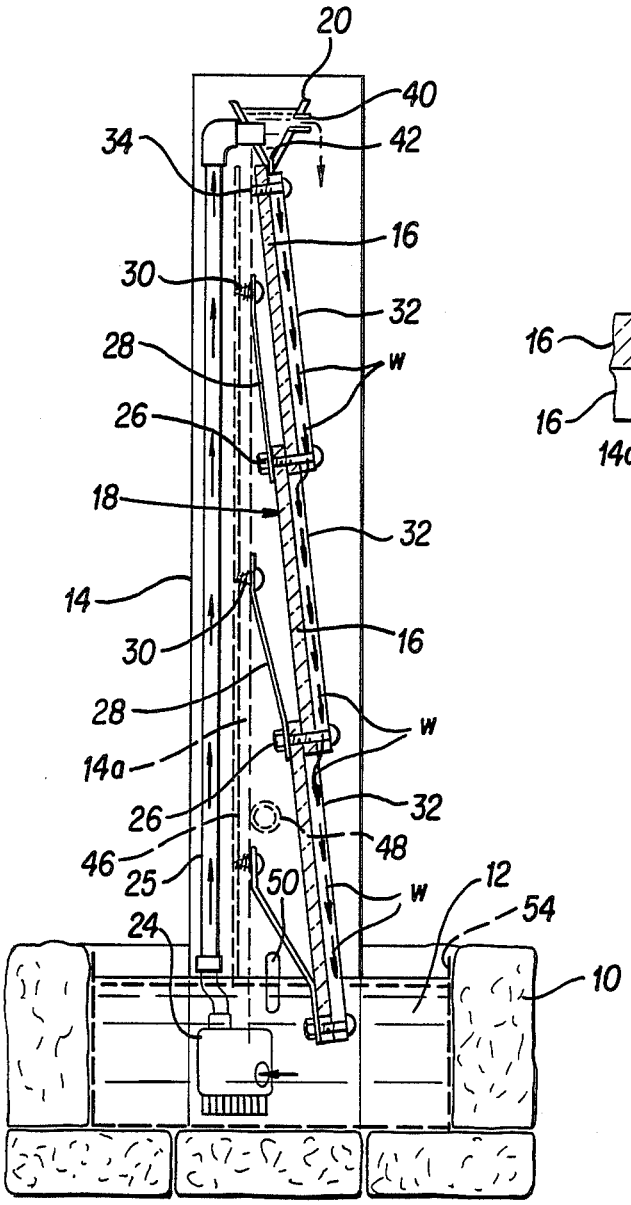
FIG. 2 shows an end, partial cross-sectional view of the water wall of the invention.

FIG. 2 also shows the base member 10 formed of a water-impermeable material for containing a pool of water indicated generally at 12. The base 10 may be constructed of stone, brick or tile with a plastic or fiberglass liner, as indicated at 54. The supports 14 are shown as being supported directly by a bottom portion of the base 10. Those of skill in the art will recognized that a wide variety of methods of connecting supports 14 to the base 10 are within the skill of the art, and that selection thereof can be made in accordance with typical engineering criteria, and aesthetics. For example, it might be desired to make the supports 14 of walnut or another attractive wood. If so, the connection of the supports 14 to the base 10 would naturally be such that the supports 14 are not directly exposed to the water of pool 12. Suitable mounting structure is deemed to be within the skill of the art. The supports 14 might also be made of materials such as stainless steel or aluminum, or could even be formed of a plastic or fiberglass material. Decorative shrouds could surround relatively straightforward support members. Preferably, the base is arranged such that the weight of the water stabilizes the entire assembly. As generally indicated, the provision of appropriate mounting structure chosen in conjunction with desired materials for support members 14 is within the skill of the art.

FIG. 2 also shows one possible method of making the multiple-paned assembly 18 of the planar panel members 16. In the embodiment shown in FIG. 2, the multiple panes 16 are connected by bolts 26, which also affix the joints of the various panes 16 to strap members 28, which in turn are affixed by screws 30 to the upright support members 14. The bolts 26 may also support reinforcing bars 32, the upper edges of which abut the lower edges of the panes 16, for further supporting the same, as shown in FIG. 2. The uppermost support member 32 may be connected directly by bolt 34 to the support member 14.

As indicated by dotted line **14*a*, if the support member 14 is formed of wood, the bolts 26 and 34 may be bolted to back walls of grooves or rabbets formed in the facing surfaces of the support members 14. The net effect is to conceal as much as possible the mounting hardware from viewers viewing the water wall of the invention, that is, looking leftwardly towards the water flowing in FIG. 1. In a preferred embodiment, only the panels, the water flowing thereover, the trough 20, the supports 14 and the base 10** are visible from this vantage point. A number of additional expedients for the mounting of the panes are within the skill of the art.

Figure 3:
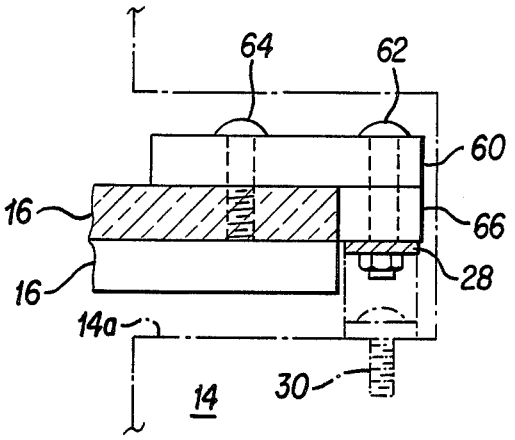
FIG. 3 shows a top view of a portion of the water wall of the invention.

One of the preferred materials for the panels 16 of assembly 18 is tempered glass. Those of skill in the art will realize that the drilling of holes in glass panels is somewhat difficult. FIG. 3 shows a top view of a connection between adjoining glass panels which avoids the necessity of drilling holes therein. A first glass panel 16 is supported on its underside by a steel bar 66. A thin gasket of a semi-resilient material may be interposed between support bar 66 and panel 16 to prevent direct contact therebetween. Bar 66 is bolted by two bolts 62 and 64 to a second steel strap 60, which extends up along the edge of the panel. Bolt 64 is threaded into bar 66, so as to avoid impinging on second panel 16. Strap 28, connecting the joint of the panels to the upright 14, is attached to the joint by bolt 62.

As discussed above, it is an object of the invention to avoid substantial splashing of the water, so as to avoid damaging of any household goods formed of water-damageable materials disposed in the vicinity of the water wall of the invention. It will be appreciated by those skilled in the art that the flow rate of the water from the trough 20 down over the panels 16, the degree to which the surface roughness of the panel assembly 18 causes the water to separate from the surface and drop directly downwardly, and the inclination of the panels 16 with respect to the vertical are all significant in avoiding splashing in favor of "burbling" the water over the surface of the assembly, including the joints between the panels 16. Direct contact between the panes reduces the amount of turbulence imparted to the downwardly flowing water stream, indicated by arrows W in FIG. 2, in the vicinity of the joints between ones of the panels 16. For similar reasons, the trough 20 should only be filled to the level needed to keep a minimum pressure "head" of water in the trough. An overflow drain 40 (draining excess water by a tube (not shown) to the pool) may be provided to keep the water level at the desired height, limiting pressure of the water leaving the aperture 42 in the trough. This in turn controls the rate of water flow over the multiple-paned assembly 18, and prevents splashing.

It will be appreciated that there has been described a self-contained, free-standing water wall which is decorative by virtue of its provision of the very attractive water patterns flowing in sheets, gracefully and appealingly over the multiple-paned assembly 18, as shown perhaps most clearly in FIG. 1, yet in which substantial splashing is avoided in favor of burbling flow. More specifically, the inventors find that by judicious selection of the water flow rate, the angles of the panels, and their thickness (which, in turn, controls the horizontal displacement between the lower edge of an upper panel and the surface of the lower panel), water flow is generally as shown in FIG. 2 by the arrows W; that is, water tends to adhere to the assembly 18 and not drip from the lower edge of one panel 16 to the surface of the next. This latter dripping would appear to cause a more violent water motion and attendant splashing than does the adherent flow shown. In this way, splashing is avoided in favor of burbling, which in turn avoids splashing large water droplets into the air. Such large droplets would tend to damage water-vulnerable household furnishings in the vicinity of the water wall of the invention.

In a successfully tested embodiment of the invention, the following specific characteristics were employed. The overall panel assembly was 76" long by 134" high, inclined at ½° to the vertical, and included four panes of glass, which were tightly abutting one another in the manner depicted in FIG. 2. A pump having a flow rate of 8 gpm was used. The trough had a slot 0.020" wide formed extending over substantially its entire length. A water depth of 2" in the trough 20 was typical. Distilled water was used to avoid water spotting of the device. No. significant splashing was observed.

It will also be appreciated by those of skill in the art that adherent flow may also occur with panels inclined to the vertical at a negative angle of perhaps as much as −2°-3°. Surface treatment of the panels and additions of surfactants to the water may also be useful in connection with the practice of the invention. Such expedients are considered to be within the scope of the invention.

At the same time, the burbling flow does provide some quantity of very, very fine droplets, which are more likely to be suspended in the air than are larger drops, whereby a contribution to the humidity of the room in which the water wall is located is made.

A number of additional features, variations, and advantages of the invention can now be described.

It will be appreciated that the material of the panes 16 will have significant effect on the aesthetics of the water wall according to the invention. The applicants have had extremely pleasing results with the use of glass as the material of panels 16, so that glass is indicated in the cross-section of FIG. 2. The front or back surfaces of the glass may be painted, either with an opaque paint or with a colored pattern, for additional aesthetic appeal. It may also be desirable in some embodiments to place a screen 46 behind the assembly 18 of the multiple panes 16. This screen 46 could be placed either between the assembly 18 and the pipe 25 connecting the pump 24 and the trough 20, or could be on the rear side of the pipe 25. It will also be appreciated that it would be possible to provide dual assemblies 18 of the multiple panes 16 "back-to-back," and that they could both be served by a single trough 20, possibly having plural outlets 42. It will also be appreciated, of course, that the outlets 42 may be formed as a slot extending the length of the trough 20, may be a number of holes drilled along the bottom of the trough 20, or the equivalent. The point is to provide a water dispersal means which is adapted to provide a smooth, laminar or "sheet-like" flow of water, which is suitable for burbling, non-turbulent flow. Thus, another possible embodiment of the water dispersal means would be a tube having a number of holes drilled at intervals along a line directed at the uppermost panel, for providing a smooth, non-turbulent, essentially laminar or sheet-like flow downward over the assembly 18 of the panels 16.

As shown, a pipe 25 connects a pump 24 having an intake indicated by an arrow disposed in the pool 12, to the trough 20; obviously, a wide variety of pumping, piping, and trough arrangements could be employed, while remaining within the scope of the invention. A filter might also prove desirable.

Another possibility would be to incorporate one or more lamps as indicated at 48 behind the panels 16 of the multiple-paned assembly 18; this would add additional aesthetic possibilities.

As mentioned above, a wide variety of materials and construction techniques can be employed to implement the water wall according to the invention. For example, while a base member 10 of brick, including a brick bottom as shown in FIG. 2, has been shown in the drawings, the base member could be formed of a wide variety of materials, using a wide variety of construction techniques. For example, if considered aesthetically acceptable, the entire base member 10 could be poured concrete. Use of such porous materials would require the use of a waterproof liner. Base 10 might alternatively be formed of fiberglass or another durable plastics material. Such a concrete or formed plastics base member 10 would desirably include means for ready mounting of the support members 14. Another possibility for the base material would be stone; this might be particularly appealing in combination with wooden uprights 14 and trough 20, and with glass panels 16 making up the multiple-paned assembly 18.

It will also be appreciated that while the water wall of the invention has been described as a unitary, free-standing unit, it would also be possible to integrate a water wall according to the invention into the structure of a building. The base portion 10 could be formed as part of a floor, for example, or be elevated above floor level, and support members 14 could be integrated with a wall, such that the panel assembly 18 would be recessed in a structure wall.

Another desirable feature of a preferred embodiment of the invention is that it be readily assembled while being shippable in knocked-down form for economy in shipment. For example, base member 10 might be formed to include sockets for securely retaining the supports 14. Supports 14 similarly should be readily assembled to the multiple-paned assembly 18.

As mentioned, the support members 14 could be formed out of a wide variety of materials, including, without limitation, wood, metals, fiberglass or other plastics and the like. Similarly, the trough 20 could be formed of a wide variety of material including metals, plastics and wood; perhaps, in a particularly aesthetic version of the invention in which the uprights 14 are made of a finely grained wood such as walnut, which is however subject to water damage, trough 20 could comprise a fiberglass trough member shrouded on its sides by walnet panels, for concealing the fiberglass trough and matching the characteristics of the uprights 14.

Similarly, while a workable method of mounting the multiple-paned assembly 18 to the supports 14 has been shown, a wide variety of additional possibilities are within the skill of the art. Wide variation in the shapes of the panel members 16, which have been shown as essentially rectangular with their edges parallel is possible without departing from the essential spirit and scope of the invention. For example, the discontinuities between the panels of assembly 18 need not be entirely horizontal.

As additional examples of the breadth to be accorded this invention, the panels 16 of the multiple-paned assembly could be formed of a wide variety of materials; of course, different materials could be used within a single assembly 18. The panels could be clear, colored or coated glass, clear or colored plastics or other materials; they might be flat or textured; they might be mirrored, colored with a single color, tinted, coated with an opaque paint or have a pattern printed thereon. As mentioned, backlighting could be provided for illumination; the lighting could be varied with time according to a predetermined pattern, and so on.

Similarly, while the assembly 18 has been disclosed as made up of a number of panels of generally planar material, such as sheets of glass, the assembly 18 could be a unitary panel, subject solely to the constraint that it provide an aesthetic effect when water flows thereover, while not causing excessive splashing of the water. The assembly 18, of course, need not be flat, nor rectangular in overall shape.

Finally, it will be appreciated by those skilled in the art that the water wall according to the invention provides excellent aeration to the water. Therefore, the pool at the base of the water wall is ideal for aquarium purposes, needing only to be fitted with temperature controller means for use in conjunction with tropical fish and the like, and therefore this is deemed to be an additional important aspect and use of the water wall of the invention. A typical aquarium heater 50 (FIG. 2) is shown for this purpose; water temperature control may also be of use in controlling the amount of humidity imparted to the surrounding atmosphere by the device of the invention.

Therefore, while a preferred embodiment of the invention has been described in the foregoing, this should not be considered as a limitation on the invention, but only as exemplary thereof. The invention is to be limited only by the following claims.

What is claimed is:

1. A water wall comprising:

base means, comprising means for containing a pool of water having a pool surface;

pump means for pumping water from said pool;

water dispersal means for providing an essentially laminar flow of water at a flow rate;

piping means, connected between said pump means and said water dispersal means;

a waterfall panel assembly comprising a number of essentially smooth members in edge-overlapping, abutting relationship to one another, the smooth members of said assembly being generally parallel to one another and having respective lower edges, surfaces for receiving said laminar flow of water, the surfaces of said smooth members being nonenclosed; and support means for maintaining the members of said assembly at a predetermined angle of inclination with respect to the vertical, and for supporting said water dispersal means generally above said panel assembly;

wherein the flow rate of water, horizontal distance between the lower edges of ones of said smooth members of said panel assembly and the surfaces of next lower smooth members of said panel assembly, and angle of inclination of said smooth members being such that water flowing over said smooth members of said panel assembly tends to adhere thereto, whereby splashing of said water is largely avoided.

2. The water wall of claim 1, wherein:

said angle of inclination is an angle between about $-3°$ and $+15°$ with respect to the vertical.

3. The water wall of claim 2, wherein the lower edge of a lowermost smooth member of said panel assembly is adapted to be beneath said pool surface when said water wall is in use.

4. The water wall of claim 2, wherein said smooth members are formed of glass.

5. The water wall of claim 2, wherein said smooth members are formed of an acrylic material.

6. The water wall of claim 5, wherein the essentially smooth members of said panel assembly have a textured surface which is still substantially smoother than where said essentially smooth members abut one another in said edge-overlapping relationship.

7. The water wall of claim 2, wherein said water dispersal means for producing an essentially laminar flow of water comprises trough means having water outlet means sized to provide a predetermined rate of flow of water when said trough is filled with water to a level of water which is a predetermined level.

8. The water wall of claim 7, wherein said water dispersal means is provided with means for maintaining the level of water in said trough at said predetermined level.

9. The water wall of claim 2, further comprising means for controlling temperature of said water, whereby living marine life may be sustained in said pool of water in said base and/or air humidity about said water wall may be affected.

10. The water wall of claim 2, wherein said panel assembly is greater than about five feet in height.

11. The water wall of claim 2, wherein said panel assembly is greater than about thirteen feet in height.

12. The water wall of claim 1, wherein:

said essentially smooth members are essentially planar.

13. The water wall of any one of claims 1, 12, 10 or 9, wherein said water wall is a free-standing unit.

14. The water wall of any of claims 1, 12, 2, 11, 3 or 9, wherein said angle of inclination is between about 0° and about 5°.

15. A combined decorative object and humidifier, comprising:

a substantially nonenclosed panel assembly, having a top and a lowermost portion, and having discontinuities with shape and size, means adapted to support said panel assembly at a predetermined angle of inclination with respect to the vertical, and means located at the top of said panel assembly for establishing an essentially laminar flow pattern of water such that water flows smoothly at a flow rate downward over said panel assembly, wherein the water flow rate, the shape and size of the discontinuities, and the angle of inclination of said panel assembly with respect to the vertical are such that water tends to burble over said discontinuities without excessive splashing thereof.

16. The apparatus of claim 15, wherein said discontinuities are formed such that when said panel assembly is supported by said support means, said discontinuities include a horizontal component.

17. The apparatus of claim 16, wherein:

said angle of inclination is between about $-3°$ and about $+15°$ with respect to the vertical.

18. The apparatus of 17, further comprising a pool in which the lowermost portion of said panel assembly is disposed, wherein said water is collected after having flowed over said panel assembly.

19. The apparatus of claim 18 further comprising pump means for motivating water from said pool to said means for establishing a laminar water flow pattern.

20. The apparatus of claim 16, wherein said panel assembly comprises an assembly of a number of generally planar panels arranged in edge-overlapping, abutting relationship to one another, wherein a thickness of each of said panels defines a horizontal component between a lower edge of an upper one of said panels and a surface of a lower abutting panel.

21. The apparatus of claim 17, wherein said panels are formed of glass.

22. The apparatus of claim 17, wherein said panel assembly is greater than about five feet in height.

23. The apparatus of claim 17, wherein said panel assembly is greater than about thirteen feet in height.

24. The apparatus of claim 17, wherein said panel assembly is at least partially transparent to light and light transmission characteristics of said panel assembly are chosen to effect an aesthetic goal.

25. The apparatus of claim 24 further comprising means for causing light to be transmitted through at least a portion of said panel assembly.

26. The apparatus of any one of claims 15, 18, 20 or 22, further comprising base means for supporting said panel assembly and said means for establishing a laminar flow pattern of water over said panel assembly.

27. The apparatus of claim 26, wherein the materials of said base means, said support means and said panel are chosen for aesthetic coordination with one another.

28. The apparatus of any one of claims 15, 18, 20, 17 or 22, further comprising means for controlling the temperature of said water, whereby air humidity about the water wall may be affected.

29. The apparatus of any one of claims 15, 18, 20, 17, or 22, wherein said means for establishing a laminar flow pattern of water comprises means for containing a quantity of water and for dispersing said water in a smooth, non-turbulent, substantially sheet-like flow pattern.

30. The apparatus of claim 29, wherein said means for dispersing said water comprises means for controlling the flow rate of said water.

31. The apparatus of any one of claims 15, 18, 20, 17 or 22, wherein said panel assembly makes an angle of between about 0° and about 5° with respect to the vertical.

* * * * *